United States Patent [19]

Hernqvist

[11] 4,406,637

[45] Sep. 27, 1983

[54] PROCESSING THE MOUNT ASSEMBLY OF A CRT TO SUPPRESS AFTERGLOW

[75] Inventor: Karl G. Hernqvist, Princeton, N.J.

[73] Assignee: RCA Corporation, New York, N.Y.

[21] Appl. No.: 279,740

[22] Filed: Jul. 2, 1981

[51] Int. Cl.[3] ..... H01J 9/00; H01J 9/385

[52] U.S. Cl. ..... 445/45; 445/6; 445/57

[58] Field of Search ..... 316/1, 18, 19, 20, 21, 316/22; 29/25.17; 445/5, 6, 57, 19, 45

[56] References Cited

U.S. PATENT DOCUMENTS

| | | | |
|---|---|---|---|
| 3,115,732 | 12/1963 | Stewart | 53/88 |
| 3,922,049 | 11/1975 | Sawicki | 316/19 |
| 4,073,558 | 2/1978 | Benda et al. | 316/18 |

FOREIGN PATENT DOCUMENTS

| | | | |
|---|---|---|---|
| 55-143751 | 11/1980 | Japan | 316/1 |

OTHER PUBLICATIONS

"Composition-vs-Depth Profiles Obtained with Auger Electron Spectroscopy of Air-Oxidized Stainless-Steel Surfaces," by G. Betz et al., *Journal of Applied Physics*, vol. 45, No. 12 (1974) pp. 5312 to 5316.

*Primary Examiner*—Kenneth J. Ramsey
*Attorney, Agent, or Firm*—E. M. Whitacre; D. H. Irlbeck; L. Greenspan

[57] ABSTRACT

Before a CRT is tipped off following exhaustion of gases to a low pressure, at least a portion of one of the electrodes of the mount assembly (e.g., the grid electrode facing the anode) is heated to high temperatures, preferably about 700° to 800° C., in an atmosphere having a partial pressure of oxygen.

10 Claims, 3 Drawing Figures

PROCESSING THE MOUNT ASSEMBLY OF A CRT TO SUPPRESS AFTERGLOW

BACKGROUND OF THE INVENTION

This invention relates to a novel method of processing the mount assembly of a CRT (cathode-ray tube) to suppress afterglow therein after the CRT has been operated. The novel method involves a critical heating of the mount assembly before the CRT is tipped off.

A CRT comprises an envelope which includes a neck, a funnel and a faceplate. A viewing screen and various coatings are applied to internal surfaces of the envelope. A mount assembly, supported from a glass stem and including an electron gun or guns, is sealed into the neck of the envelope. After the mount assembly is sealed into the neck, the CRT (which is open to the atmosphere through a glass tubulation connected to the stem) is baked at about 300° to 450° C. and is simultaneously exhausted to a relatively low pressure below $10^{-4}$ torr through the glass tubulation. During this baking, the temperature of the mount assembly rises to about 250° to 300° C. Then, the CRT is tipped off, that is, the tubulation is sealed. Near the end of the baking cycle and prior to tipping off, when the CRT is exhausted to a low pressure, RF energy is applied to degas metal structures, particularly the electrodes of the mount assembly. The RF energy heats the metal structures to a maximum temperature above 450° C., usually about 600° to 750° C., in order to drive out occluded and adsorbed gases. After tipping off, the mount assembly is subjected to spot-knocking to reduce spurious electron emission therefrom and to stabilize the operation of the CRT.

A completed CRT, installed in a chassis, and operated in a normal manner, may continue to emit light from the viewing screen after the normal operating voltages are removed from the mount assembly. This effect, which may linger for minutes or hours, is referred to as afterglow and is attributed to the coincidence of two factors. First, a large residual electrostatic charge remains on the filter capacitor (which is integral with the CRT) after the operating voltages are removed, and therefore a residual high voltage remains on the anode of the CRT with respect to the other electrodes of the mount assembly. Second, there are sites on the electrodes of the electron gun from which electrons can be emitted when they are under the influence of the electric field produced by the residual charge on the filter capacitor. Emitted electrons under the influence of the electric field are directed toward, and impinged upon, the viewing screen producing the afterglow.

SUMMARY OF THE INVENTION

In the novel method, the number and efficiency of field-emission sites are substantially reduced so that there is substantially less field emission, and little or no afterglow is observed. The novel method follows the prior method including the steps of baking up to about 450° C., exhausting to a low pressure, RF heating to a maximum temperature above 450° C. and tipping off except that, prior to achieving said low pressure, at least a portion of the mount assembly is selectively heated at superior temperatures above said maximum temperature in an atmosphere having a partial pressure of oxygen (typically in the range of 1 to 3 torr) for a time period sufficient to produce a visible discoloration thereon when cooled to room temperature and insufficient to produce an electrically-insulating layer. In a preferred embodiment, the heated portion of the mount assembly is the portion of an electrode that faces another electrode that is to carry the anode voltage. The heating to said superior temperatures may be carried out before or after the mount assembly is sealed into the neck of the CRT and, preferably, is carried out after this sealing step and during the initial stages of exhausting the envelope.

DETAILED DESCRIPTION OF THE PREFERRED EMBODIMENTS

A preferred embodiment of the novel method may be practiced in a stationary exhaust machine or in a continuous apparatus, such as that disclosed in U.S. Pat. No. 3,922,049 issued Nov. 25, 1975 to F. S. Sawicki, for example. A continuous apparatus comprises a train of exhaust carts moving around a closed elongated loop. A tunnel oven of generally U-shaped plan is located over a portion of the train of carts in a manner to enclose the faceplates and funnels of the CRTs being processed but with the stems and adjacent portions of the necks outside the enclosure. The tunnel is divided into zones which are heated to prescribed temperatures such that the faceplate and funnel of each CRT moving through the tunnel experience a desired heating profile. Near the entrance end and also near the exit end of the inside of the tunnel, RF energy is applied to the neck of the CRT, which is outside the tunnel, as described below.

Figure 1:
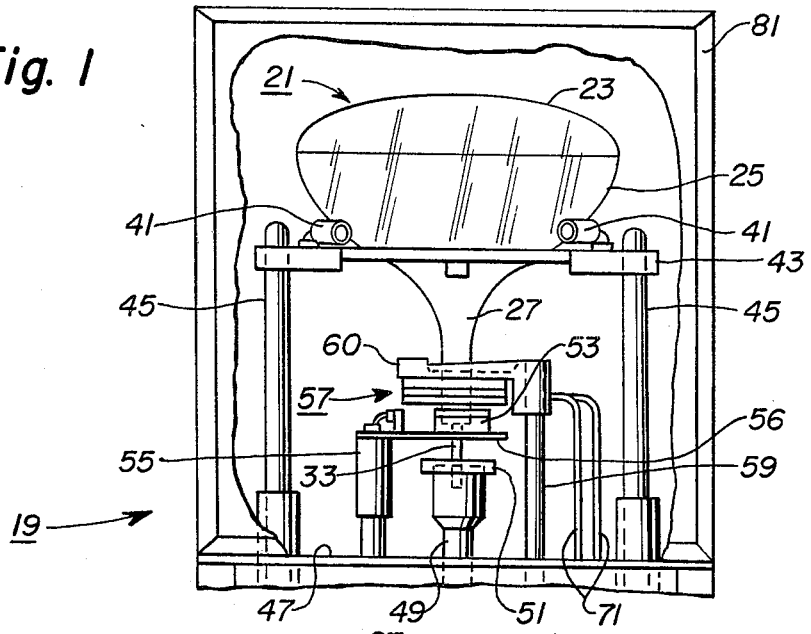
FIG. 1 is a broken-away, elevational view of a portion of an exhaust machine modified for practicing the novel method.
Figure 2:
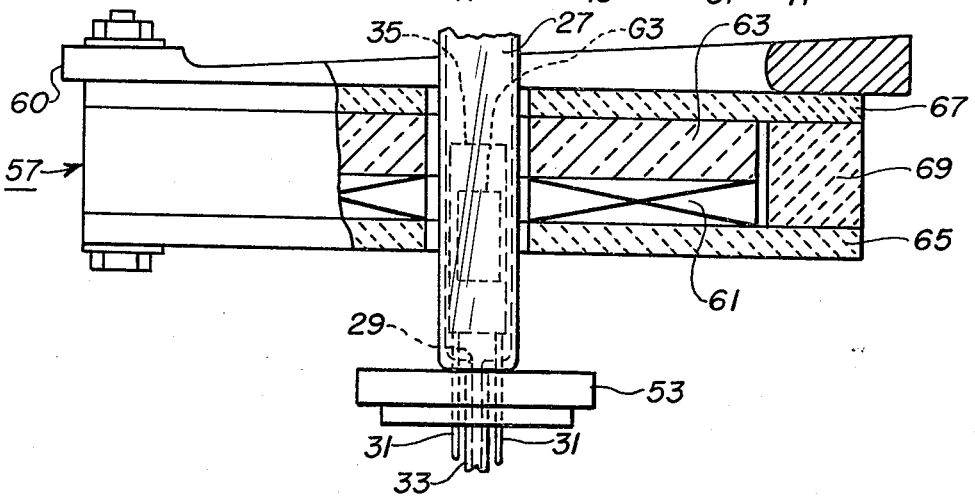
FIG. 2 is an enlarged view of the RF coil assembly of the exhaust machine shown in FIG. 1 in position for heating selected portions of the mount assembly near the start of exhausting a CRT.
Figure 3:
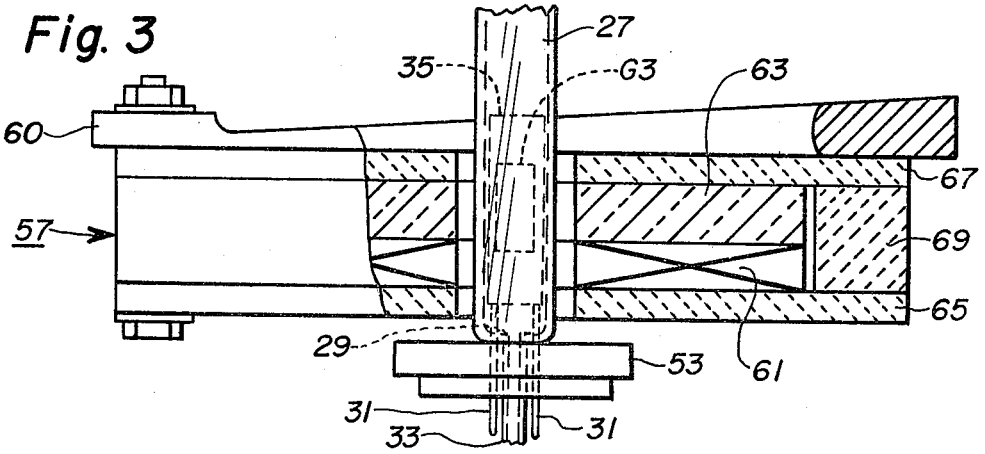
FIG. 3 is an enlarged view of the RF coil assembly of the exhaust machine shown in FIG. 1 in position for heating selected portions of the mount assembly near the end of exhausting a CRT.

In the following example, a single cart of the continuous exhaust apparatus is operated as a stationary, periodic exhaust machine. As shown in FIGS. 1 to 3, an exhaust cart or stationary machine 19 can receive one CRT 21. The CRT 21 comprises an envelope including a faceplate 23 sealed to a funnel 25 having an integral glass neck 27. The neck 27 is closed at one end by a glass stem 29 (FIGS. 2 and 3), which has metal stem leads 31 and a glass tubulation 33 extending outwardly therefrom. The stem leads 31 also extend inwardly and support a mount assembly 35 (FIG. 2) of the CRT. The mount assembly 35 includes three electron guns, each of which comprises an indirectly-heated cathode and several sequentially-spaced electrodes including a focusing electrode G3 (FIGS. 2 and 3). The mount assembly 35 may be of any of the designs which may be used in a CRT. Some such mount assemblies are described in detail in U.S. Pat. Nos. 4,234,814 issued Nov. 18, 1980 to H-Y Chen et al and 3,873,879 issued Mar. 25, 1975 to R. H. Hughes.

The exhaust machine 19 is similar in design to the exhaust cart described in U.S. Pat. No. 3,115,732 issued Dec. 31, 1963 to J. F. Stewart. The CRT is supported in the machine 19, part of which is shown in FIG. 1, on cradle arms 41, which are supported from a cradle frame 43 which is mounted on two support posts 45 attached to a thermally-insulating platform 47. The machine 19 includes an exhausting means (not shown) that is connected to a compression head 49 which extends through an opening in the platform 47. The upper end of the compression head 49 is provided with an exhaust port assembly 51 into which the tubulation 33 is received in a temporary vacuum-tight relationship. An electric radiant tipoff heater 53 is supported from the platform 47 by a tipoff heater post 55 and arm 56. The radiant heater 53 encircles the tubulation 33 adjacent the stem 29 and is operable to soften and close the tubulation 33 and thereby tip off and seal the CRT after the exhausting step is completed. An RF heater coil assembly 57 is supported from the platform 47 by an RF heater post 59 and arm 60. The RF heater coil assembly 57 is toroidal in shape, having a central aperture into which the neck 27 of the CRT 21 can be positioned. The assembly 57 comprises a toroidal-shaped coil 61 and a matching toroidal-shaped magnetic ferrite piece 63 on top of the coil 61 in an electrically-insulating, heat-resistant container made, for example, of transite. As shown in FIGS. 2 and 3, the container comprises a lower plate 65, an upper plate 67 and a spacer ring 69. The assembly 57 includes a cooling coil (not shown) supplied with circulating cooling water through pipes 71. The RF heater coil 61 is adapted to be energized for selected time periods during the heating cycle to induce RF energy into selected metal parts of the mount assembly 35.

In the novel method, it is necessary to heat a different selected portion of the mount assembly from the RF energy at the beginning of the cycle and then at the end of the cycle. To this end, means are provided for adjusting the length of the RF-heater coil post 59 above the platform 47 and thereby adjusting the position of the RF-heater-coil assembly 57 opposite the neck 27.

The above-described equipments are operated in their usual manner. The machine 19 includes a thermally-insulating enclosure 81 that can be raised from, and lowered onto, the platform 47. In practice, the enclosure 81 is raised, and a CRT 21 is loaded onto the cradle arms 41 of the machine 19. The height of the CRT above the platform is adjusted, and the exhaust port assembly 51 is temporarily sealed to the tubulation 33. Then, the enclosure 81 is lowered, and the faceplate 23 and funnel 25 are heated up to temperatures in the range of about 300° to 450° C. During the heating cycle, the inside of the CRT is continuously exhausted through the tubulation 33.

Near the beginning of the exhausting cycle, when the partial pressure of oxygen in the envelope is about 1 to 3 torr, the coil assembly 57 is positioned as shown in FIG. 2 and excited for about 2 minutes with RF energy of about 1.2 kilohertz. This effectively heats the top of the G3 opposite the anode to about 750° C. If G3 is made of a chromium alloy, this heating oxidizes the surfaces of the parts that are heated, producing a layer of chromium oxide which is resistant to heating up to at least 900° C. The effect of this heating is to oxidize the surface of the G3 particularly changing it from metallic gray to straw yellow when observed subsequently at room temperature. Near the end of the heating cycle, the RF coil 61 is positioned as shown in FIG. 3 and excited with RF energy of about 1.2 kilohertz for about 5 minutes. This induces eddy currents in the metal parts of the mount assembly 35, which heat the metal parts between the stem 29 and G3 to temperatures in the range of about 500° to 850° C. depending upon the heating time.

After completion of the RF excitation, at the end of the heating cycle, the tipoff heater 53 is activated to heat a small area of the tubulation 33 to soften the glass, which, due to atmospheric pressure, collapses and seals to itself, thereby sealing the interior of the CRT 21 from the atmosphere. The CRT 21 is permitted to cool, and the excess tubulation 33 is cracked off. Then, the enclosure 81 is raised, and the CRT is disengaged and removed from the machine. A base (not shown) is now attached to the stem leads 31, the getter (not shown) in the CRT is flashed and the mount assembly 35 is subjected to an electrode processing program including cathode activation, electrical aging and spot knocking.

In this example, the RF heating near the beginning of the heating cycle is used to oxidize the upper portion of the G3 electrode. This procedure (heating the portion of the G3 during the initial stage of exhausting when the partial pressure of oxygen is about 1 to 3 torr) has been found to produce a drastically lower percentage of CRTs that exhibit afterglow. The reasons for this are not completely understood. The procedure produces a thin layer of metal oxide on portions of the mount assembly that are believed to have sites for field emission.

In a series of tests, the top part of G3 facing the anode was heated for two minutes at 700° C. in forevacuum during pumpdown of the CRT and then brought to room temperature and pressure. During the heating step, the pressure was about 10 torr of gas including a partial pressure of about 2 torr of oxygen. These conditions caused a light brown discoloration of the G3 surface when observed at room temperature. After the usual subsequent processing including exhausting and tipping off the CRT, the discoloration remained and the extinction voltage was about 35 kilovolts. The extinction voltage is the highest residual voltage between G3 and the anode at which no afterglow is observed with the naked eye. The extinction-voltage test is conducted in a dark room with the eye dark-adapted. Where the CRT exhibits afterglow, the extinction voltage is usually below 25 kilovolts. Then, after testing, G3 was RF heated in low vacuum of less than $10^{-5}$ torr at 800° C. for about 15 minutes. This caused no obvious color change on G3.

It is known that an oxide film on a metal surface raises the work function of the surface, thus raising the energy threshold for electron emission, and thereby reducing afterglow. Some oxides are volatile at normal RF heating temperatures in a vacuum, resulting in a loss of oxide and increases in afterglow. The novel method produces a metal oxide layer on G3 that is substantially nonvolatile in vacuum at these normal RF heating temperatures. The novel method may be applied to any metal or alloy which produces an oxide that does not evaporate during the subsequent processing.

In the case of stainless steel electrodes, which is a common material used for electrodes in a CRT, predominantly iron oxides are produced during normal processing at temperatures below 500° C. See G. Betz et al, *Journal of Applied Physics* 45, 5312–5316 (1974). These iron oxides evaporate in a vacuum at temperatures above 500° C. and therefore disappear during the later stages of the usual CRT processing, and the resultant CRT exhibits increased afterglow. The oxide film formed at higher temperatures (e.g., 700° to 800° C.) is predominantly chromium oxide, which does not evaporate under the usual exhausting and RF heating conditions. A CRT produced by the novel method therefore retains a metal oxide film and thereby exhibits less afterglow.

In order to classify the degree of oxidation used for stainless steel G3, a series of G3 samples was heated in air for 30 minutes at different temperatures as shown in the Table. Tubes were assembled, and the G3 of each tube was oxidized in forevacuum by RF heating to match the surface color with Sample Nos. 1, 3 and 5. They all yielded extinction voltages of 34 kilovolts or higher. Thus, any surface discoloration by the novel method is considered beneficial.

TABLE

| Sample No. | Heating in Air for 30 Mins. at | Color after Heating |
|---|---|---|
| 1 | 350° C. | Light Yellow |
| 2 | 402° C. | Yellow |
| 3 | 448° C. | Light Brown |
| 4 | 504° C. | Copper Color |
| 5 | 556° C. | Purple |

The thin oxide on G3 is easily damaged by sliding a metal tool over its surface, such as the alignment jig used in making the guns. Thus, it is preferred that the oxidation should be done after the mount is completely assembled. The thickness of the oxide is a function of heating temperature, heating time and of the partial pressure of oxygen. If oxidation at these higher temperatures were done at atmospheric pressures, an oxide layer would build up in a time too short for effective process control. Too thick an oxide layer on G3 would result in an electrically-insulating layer, which is undesirable because it may interfere with the proper functioning of the electron gun. By electrically-insulating is meant that the layer will store a charge for several minutes. On the other hand, if the oxygen pressure is too low, an impractically long time is required to produce the desired layer. It is desirable to proceed with the oxidation until a yellowish oxide layer is formed. This may be produced by heating at about 800° C. for about 2 minutes at an air pressure of 10 torr (2 torr of oxygen). The oxidizing could also be done in a regular oven at atmospheric pressure (760 torr) in a mixture of 10 torr of air and 750 torr of argon, for example.

What is claimed is:

1. In a method of making a cathode-ray tube comprising an envelope and a mount assembly including a plurality of sequentially-spaced electrodes sealed in said envelope, said method including assembling said mount assembly, sealing said mount assembly into said envelope, then exhausting gases from said envelope to a low pressure below $10^{-4}$ torr and heating conductive parts of said mount assembly in said low pressure to a maximum temperature above about 450° C., the improvement comprising, prior to achieving said low pressure, selectively heating at least a portion of one of said electrodes of said mount assembly at superior temperatures above said maximum temperature in an atmosphere having a partial pressure of oxygen gas substantially greater than $10^{-4}$ torr for a sufficient time period to oxidize the surface of said at least one electrode to produce a visible discoloration thereon when cooled but insufficient to produce an electrically-insulating layer on said surface.

2. The method defined in claim 1 wherein said electrode portion is selectively heated by applying radio-frequency energy thereto during the initial stages of said exhausting step.

3. The method defined in claim 2 wherein said electrode portion is selectively heated by applying radio-frequency energy thereto prior to said exhausting step.

4. The method defined in claim 1 wherein said electrode portion is that part of an electrode that faces an electrode that is to carry the anode voltage of said tube.

5. The method defined in claim 1 wherein said electrode portion is selectively heated to superior temperatures in the range of about 700° to 800° C.

6. The method defined in claim 1 wherein said electrode is of a metal alloy constituted of a substantial proportion of a metal which forms an oxide having a low vapor pressure at said superior temperatures.

7. In a method of making a cathode-ray tube comprising an envelope and a mount assembly sealed in said envelope, said mount assembly including a cathode and a plurality of electrodes sequentially spaced from said cathode, said electrodes including an anode electrode most remotely spaced from said cathode for carrying the highest positive voltage on said mount assembly, and a grid electrode adjacent said anode electrode, said grid electrode being constituted of an alloy containing chromium, said method including the steps of assembling said mount assembly, sealing said mount assembly into said envelope, exhausting gases from said envelope to a low pressure below $10^{-4}$ torr, applying radio-frequency energy to said mount assembly during a portion of said exhausting step to heat metal parts of said mount assembly to a maximum temperature above 450° C. in said low pressure, and then sealing said envelope, the improvement comprising selectively heating at least the portion of said grid electrode that faces said anode electrode at superior temperatures above said maximum temperature in an atmosphere having a partial pressure of oxygen in the range of about 1 to 3 torr prior to achieving said low pressure.

8. The method defined in claim 7 wherein said grid electrode portion is heated at superior temperatures in the range of about 700° to 800° C. until the surface of said grid electrode is discolored when viewed at room temperature.

9. The method defined in claim 7 wherein said heating is continued for a time period such that the surface of said heated portion, when cooled to about room temperature, exhibits a color change from metallic gray to about a light straw color.

10. The method defined in claim 7 wherein said grid electrode portion is heated at about 800° C. for about 2 minutes and the partial pressure of oxygen is about 2 torr.

* * * * *